US007337908B2

(12) United States Patent
Dedmon

(10) Patent No.: US 7,337,908 B2
(45) Date of Patent: Mar. 4, 2008

(54) CONTAINER FOR BULK HANDLING OF FLUIDS

(76) Inventor: Franklin Dedmon, P.O. Box 30, Milan, TN (US) 38358

( * ) Notice: Subject to any disclaimer, the term of this patent is extended or adjusted under 35 U.S.C. 154(b) by 35 days.

(21) Appl. No.: 11/270,911

(22) Filed: Nov. 10, 2005

(65) Prior Publication Data

US 2007/0102314 A1 May 10, 2007

(51) Int. Cl.
*B65D 19/00* (2006.01)

(52) U.S. Cl. ..... 206/600; 220/4.33; 220/495.06

(58) Field of Classification Search ..... 206/386, 206/600; 220/4.28, 4.33, 9.1–9.4, 630, 636, 220/495.05, 495.06, 666; 108/51.11, 55.1; 383/109, 119

See application file for complete search history.

(56) References Cited

U.S. PATENT DOCUMENTS

| | | | | |
|---|---|---|---|---|
| 2,926,830 | A | 3/1960 | Kennedy et al. | |
| 3,194,471 | A | 7/1965 | Murphy | |
| RE28,846 | E | 6/1976 | Wait | |
| 4,157,609 | A | 6/1979 | Schutz | |
| 4,421,253 | A | 12/1983 | Croley | |
| 4,516,692 | A | 5/1985 | Croley | |
| 4,623,075 | A | 11/1986 | Riley | |
| 4,706,850 | A | 11/1987 | Remaks | |
| 4,793,519 | A | 12/1988 | Voorhies, Jr. | |
| 4,850,506 | A | 7/1989 | Heaps, Jr. et al. | |
| 5,031,792 | A | 7/1991 | Russo, Sr. | |
| 5,356,029 | A | 10/1994 | Hogan | |
| 5,377,876 | A | 1/1995 | Smernoff | |
| 5,381,915 | A * | 1/1995 | Yardley | 220/4.33 |
| 5,735,429 | A | 4/1998 | Whitworth | |
| 5,799,812 | A | 9/1998 | Mansouri | |
| 5,813,562 | A * | 9/1998 | Perkins | 220/495.05 |
| 6,223,903 | B1 * | 5/2001 | Mansouri | 206/600 |
| 6,533,122 | B1 | 3/2003 | Plunkett | |
| 6,543,495 | B2 | 4/2003 | Hougland | |
| 2005/0220369 | A1 | 10/2005 | Sullivan, Jr. | |

* cited by examiner

*Primary Examiner*—Luan K Bui
(74) *Attorney, Agent, or Firm*—Kenneth A. Roddy

(57) ABSTRACT

A palletized shipping container for bulk handling of fluid materials has a rigid box-like outer shell within which is positioned a flexible bag and an intermediate corrugated liner sandwiched between the walls of the bag and shell. The bag has flap-like extensions at an upper end attached to the walls of the shell to maintain the bag in an erect uncollapsed configuration, a non-removable bung at its top end, and a non-removable discharge valve adjacent its bottom end. The bung is releasably retained at the top of the liner to maintain the bung in a proper position and prevent sagging of the bag. An inwardly and downwardly angled cushioned surface at the bottom of the shell supports the liner and bag, provides additional cushioning, facilitates emptying of the bag, and reduction of residual material. The pallet allows 4-sided entry of fork lift forks.

14 Claims, 4 Drawing Sheets

CONTAINER FOR BULK HANDLING OF FLUIDS

BACKGROUND OF THE INVENTION

1. Field of the Invention

This invention relates generally to palletized shipping containers for bulk handling of fluent materials, and more particularly to palletized shipping containers having a collapsible bag encased in a strong outer shell for bulk handling of liquids, fine powders, granular products and other matter with flow characteristics.

2. Background Art

Containers and Intermediate Bulk Containers (IBC) are frequently used to ship, store, dispense, and handle liquids and other free flowing materials such as powders, pellets, etc. IBC's are also sometimes referred to as "totes". IBC's typically hold more than a 55-gallon drum but less than bulk (500-gallon) containers. The most popular sizes are 275 gallon (equal to five 55-gallon drums) and 330 gallon (equal to six 55-gallon drums). Some IBC's are of a "bag-in-a-box" construction wherein a primary container in the form of a flexible collapsible inner bag actually contains the material and a rigid box-like structure that forms a secondary container houses the flexible bag.

Containerized fluids experience severe handling forces such as vibrations, incline-impact, and droppage during shipment. In the "bag-in-a-box" type of shipping containers, the outer walls of the enclosed bag are subjected to continuous and abrasive movement of the bag against the walls of the rigid container. Such abrasion can result in bag breakage and leakage and resultant loss of contents and contamination of the surrounding area.

These "bag-in-a-box" type of shipping containers typically include valve and spout assemblies that are removably attached to the inner bag. Removable valves and spouts are undesirable because of the need to keep track of separate parts. Shipping of the valve and spout assembly parts is often done separately from the material, resulting in extra shipping costs, lost valves, incorrect fittings, broken pieces, and wasted time and effort. Removable valve and spout assemblies also require the extra effort of attaching the spout and valve to the container before the removal of the material. In addition, special tools may be needed for the attachment and removal of these assemblies, which creates a further hindrance.

Another problem with conventional "bag-in-a-box" type of shipping containers is that the floor of the outer shell or rigid container on which the collapsible inner bag is supported is flat and, thus, optimal emptying of the bag is difficult to achieve and residual material often remains in the bag.

When transporting palletized containers of the type described above from the manufacturer to the filling station, from the filling station to the customer, from the customer to the reconditioner and so on, the large-volume containers are loaded many times from the truck or a large container to conveyors and are being picked up and set down by fork lifts. The pallet configurations of most conventional palletized containers allow entry of the forks of the fork lift from only two of the four sides. Thus, access for lifting and handling is significantly limited and there is a likelihood of damage, spillage or leakage due to accidentally dropping a filled container.

Kennedy et al, U.S. Pat. No. 2,926,830 discloses a cardboard box having a liquid-tight plastic liner.

Murphy, U.S. Pat. No. 3,194,471 discloses a container having a flexible liner surrounded by a polygonal fiberboard tube having open ends and secured therein by adhesive which is received in an outer fiberboard container.

Wait, U.S. Pat. No. Re 28,846 discloses a collapsible pallet box having four sidewalls each in lapped relationship with the ends of the adjacent sidewalls when the box is erected. The sidewalls have aligned horizontal cleats, and the cleats have aligned channels carrying an endless strap running around the periphery of the box. The strap is slidable in the channel, and the cleats, are designed so that the strap is tight both when the box is erected and when it is collapsed.

Schultz, U.S. Pat. No. 4,157,609 discloses a method for forming a pallet-mounted container for liquids comprising a synthetic resin container in a metal shell that supports the container. The metal shell is a sheet metal jacket with a welded-on lid and bottom and is attached to a supporting wooden pallet.

Croley, U.S. Pat. No. 4,421,253 discloses a disposable bulk shipping container assembly for containing, shipping and dispensing liquids or semi-liquids. The container comprises a knocked-down fiberboard container body and end structure which can be set up on a pallet into a substantially rigid multi-sided polygonal drum-like container for receiving a flexible plastic bag that is to be filled with the substance to be dispensed. The bag is provided with a dispensing spout that is locked in dispensing position in one side of the fiberboard container to hold the bag in position in the container during filling, with its outer end exposed and which has a diaphragm type seal at its inner end. Croley, U.S. Pat. No. 4,516,692 discloses a similar disposable bulk shipping container assembly having a spacer and baffle between the upper end of the closed filled bag and the upper end structure to prevent upward surging with resulting distortion.

Riley, U.S. Pat. No. 4,623,075 discloses a bag-in-box type of container comprising a box enclosing a flexible bag filled with a pressurized liquid, such as a carbonated beverage, wherein the bag is located either inside a tube of rigid or inelastic material or inside a closed sleeve of elastic material. With the former, transverse platforms with flanges directed towards respective ends of the box are arranged at each end of the tube to transmit pressure from the tube to the box. With a sleeve of elastic material such platforms are not required, but a slotted platform is usually provided for location of the tap which projects from the bag.

Voorhies, Jr., U.S. Pat. No. 4,793,519 discloses a composite disposable one-way container comprising an outer container of rectangular shape having upright continuous side walls and a substantially flat top wall formed of corrugated paper material. A unitary blow molded plastic inner tank having thin side walls is positioned upright inside the outer container so that the outer container maintains the inner tank in its upright position when the tank is filled with a liquid to be transported. A pallet member has a flat top supporting surface on which the outer container and the inner tank are supported.

Heaps, Jr. et al, U.S. Pat. No. 4,793,519 discloses a container for large quantities of fluent material having laminated walls made of multi-wall corrugated board. A flexible bag within the container has a first fitting that extends into an opening through a wall of the container near the bottom. A flap covers the opening and conceals the fitting being held in position by a severable strap. The container has bottom-forming flaps extending from the intermediate one of three layers forming the container to form a bottom for the container.

Russo, Sr., U.S. Pat. No. 5,031,792, which is commonly owned with the present invention by way of assignment, and which is incorporated herein by reference, discloses a container for bulk handling of fluid materials that includes a rigid outer shell structure within which is positioned a flexible bag means adapted to receive, transport and discharge fluids. An intermediate liner is positioned between the shell and the flexible bag for prevention of abrasion of the bag surface. The internal bag has a fitment or bung at the top for either filling or discharge and a threaded discharge fitment at the bottom of a side wall designed for insertion of a discharge valve through the side wall. The container is shipped without the valve installed, and in order to dispense the contents, a discharge valve is inserted by seating it into the threaded area of the fitment. While being seated, a sharp nail-like probe on the valve pierces the bag to establish a fluid flow passageway so that dispensing may take place. The collapsible inner bag is supported on a flat bottom surface of the intermediate liner.

Smernoff, U.S. Pat. No. 5,377,876 discloses a disposable bladder within in a box container having an interlocking spout wherein a locking flap in the outer container interlocks the spout and the outer container during dispensing of the contents.

Mansouri, U.S. Pat. No. 5,799,812 discloses a reusable collapsible intermediate bulk shipping container adaptable to be used with a disposable inner fill bag, supplied in a corrugated cassette, upon a standard size pallet. The container has four interlocking wall frames with insertable wall panels forming inert interior wall surfaces, an engaging top member in addition to a halfwall member provides access for positioning a standard inner fill bag drain gland. The container is set up or collapsed and secured upon the pallet for return shipping or reuse.

Plunkett, U.S. Pat. No. 6,533,495 discloses a foldable shipping container that provides users access to a liner fill port in confined areas and that can be used to transport liquids, powders, or solids. One embodiment of the shipping container has a generally rectangular base pivotally connected a first side wall and a second side wall, a first lid section pivotally connected to the first side wall, a second lid section pivotally connected to the second side wall, and a third lid section pivotally connected to the first lid section. The third lid section provides access to a centrally located liner fill port.

Hougland, U.S. Pat. No. 6,543,495 discloses a multiple access container having a holding portion adapted to hold fluent material and a transfer assembly having a flexible conduit and multiple access ports.

A multiple ply bag suitable for use in the present invention is a custom designed bag produced for the inventor by CDF Corporation of Plymouth, Mass. similar to the type described in the CDF Corporation U.S. Published patent application No. 2005/0220369 A1, the complete disclosure of which is hereby incorporated by reference. It should be noted that, as described herein, the bag of the present invention has features that are not disclosed in the referenced pending application.

The present invention is distinguished over the prior art in general, and these patents in particular by a palletized shipping container having a collapsible bag encased in a strong outer shell for bulk handling of liquids, fine powders, granular products and other matter with flow characteristics. The bag has flap-like extensions at an upper end for attachment to the shell to maintain the bag in an erect uncollapsed configuration, a non-removable bung at its top end for either filling or discharge and a non-removable discharge valve adjacent the bottom of one of its side walls. An intermediate liner formed of non-abrasive corrugated material is sandwiched between the bag and the outer walls of the rigid container for protecting the bag and minimizing shock, vibration and abrasive forces on the bag. The bung is releasably retained at the top of the liner to maintain the bung in a proper position and prevent sagging of the bag. A cushioning inwardly and downwardly angled drain surface is disposed at the bottom of the shell for supporting the bottom of the liner and bag to facilitate optimal emptying of the bag, significantly reduce the amount of residual material remaining in the bag, and provide an additional cushioning support surface for the fluid filled bag. The pallet structure is permanently attached to the outer shell and is configured to allow entry of the forks of a fork lift from any of four sides to allow better access for lifting and handling and significantly reduce the likelihood of damage, spillage or leakage due to accidentally dropping a filled container.

SUMMARY OF THE INVENTION

It is therefore an object of the present invention to provide a new and improved shipping container for liquids.

It is another object of this invention to provide a new and improved container for shipping liquids that has a separate corrugated intermediate liner to protect an internal bag from abrasive contact with the surface, corners and seams on the inner surface of an outer rigid shell.

Another the object of this invention is to provide a container for shipping bulk liquids that has an internal multiple layer collapsible bag fitted within the inner dimensions of an outer container shell and secured to the inner top portion of the outer shell to maintain the bag in an erect uncollapsed configuration.

Another the object of this invention is to provide a new and improved container for shipping bulk liquids that has an internal multiple layer collapsible bag fitted within the inner dimensions of an outer container shell which has a non-removable bung at its top end for either filling or discharge and has a non-removable discharge valve secured adjacent its bottom end.

Another object of this invention is to provide a new and improved shipping container for fluids wherein the fluid is enclosed within a flexible bag which is positioned within an outer shell, an intermediate corrugated liner is disposed between the bag and the outer shell, and the bag has a non-removable top bung releasably supported on a top wall of the liner to maintain the bung in a proper position and prevent the top of the bag from sagging.

A further object of this invention is to provide a new and improved shipping container for fluids having an inwardly and downwardly angled cushioning drain surface for supporting the bottom of the intermediate liner and flexible bag which facilitates optimal emptying of the bag, significantly reduces the amount of residual material remaining in the bag, and provides an additional cushioning support surface for the fluid filled bag.

A still further object of this invention is to provide a new and improved palletized shipping container for shipping bulk liquids that has an internal collapsible bag fitted within a rigid outer container shell having a pallet structure configured to allow entry of the forks of a fork lift from any of four sides to allow better access for lifting and handling and significantly reduce the likelihood of damage, spillage or leakage due to accidentally dropping a filled container.

Other objects of the invention will become apparent from time to time throughout the specification and claims as hereinafter related.

The above noted objects and other objects of the invention are accomplished by a palletized shipping container having a multiple layer flexible, collapsible bag positioned to closely fit within inner surfaces of a rigid box-like outer container or shell. The bag has flap-like extensions at an upper end for attachment to the shell to maintain the bag in an erect uncollapsed configuration, a non-removable bung at its top end for either filling or discharge and a non-removable discharge valve adjacent the bottom of one of its side walls. An intermediate liner formed of non-abrasive corrugated material is sandwiched between the bag and the outer walls of the rigid container for protecting the bag and minimizing shock, vibration and abrasive forces on the bag. The bung is releasably retained at the top of the liner to maintain the bung in a proper position and prevent sagging of the bag. A cushioning inwardly and downwardly angled drain surface is disposed at the bottom of the shell for supporting the bottom of the liner and bag to facilitate optimal emptying of the bag, significantly reduce the amount of residual material remaining in the bag, and provide an additional cushioning support surface for the fluid filled bag. The pallet structure is permanently attached to the outer shell and is configured to allow entry of the forks of a fork lift from any of four sides to allow better access for lifting and handling and significantly reduce the likelihood of damage, spillage or leakage due to accidentally dropping a filled container.

DESCRIPTION OF THE PREFERRED EMBODIMENT

Figure 1:
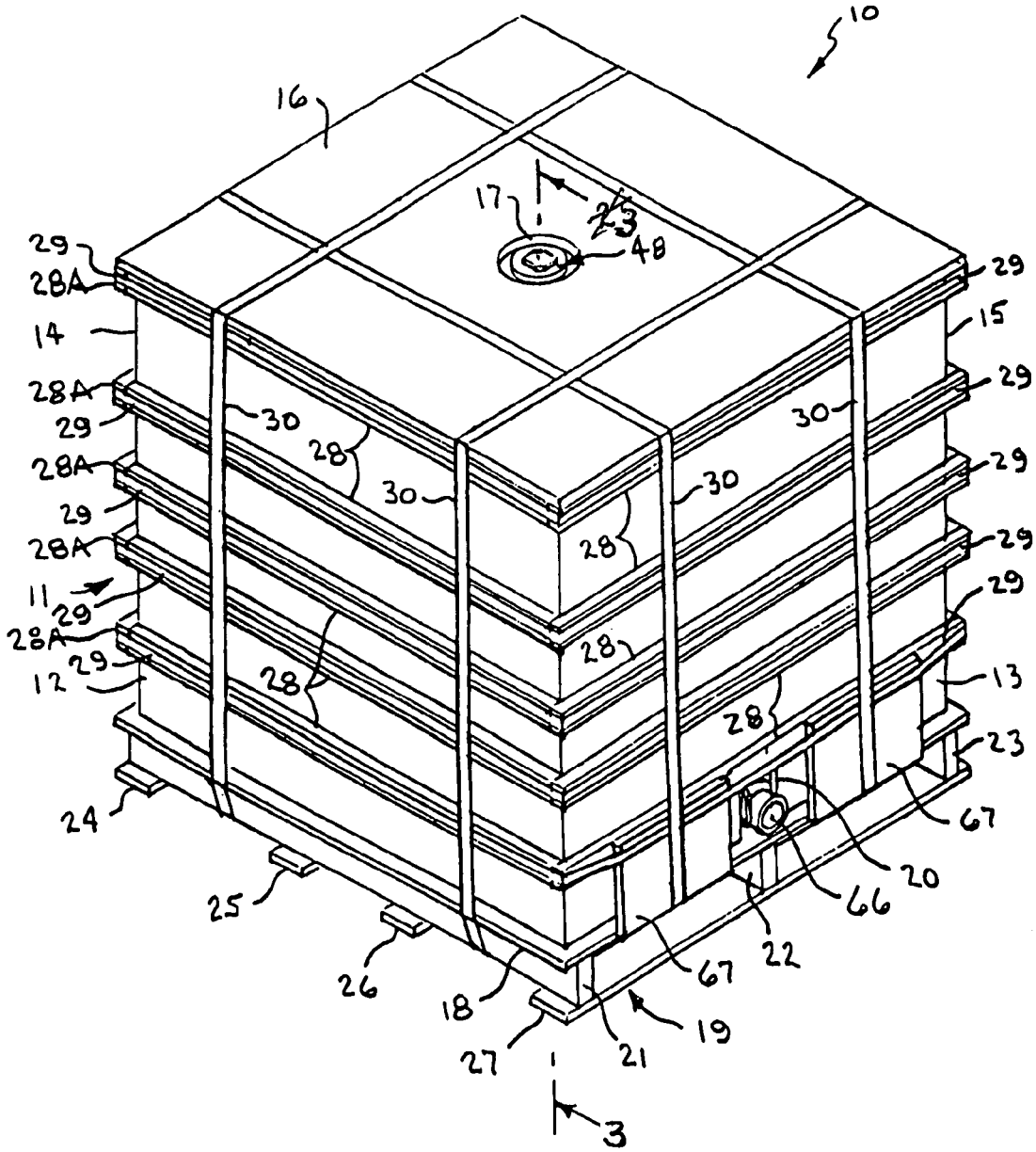
FIG. 1 is a perspective view of the shipping container in accordance with the present invention, shown in the assembled condition.
Figure 2:
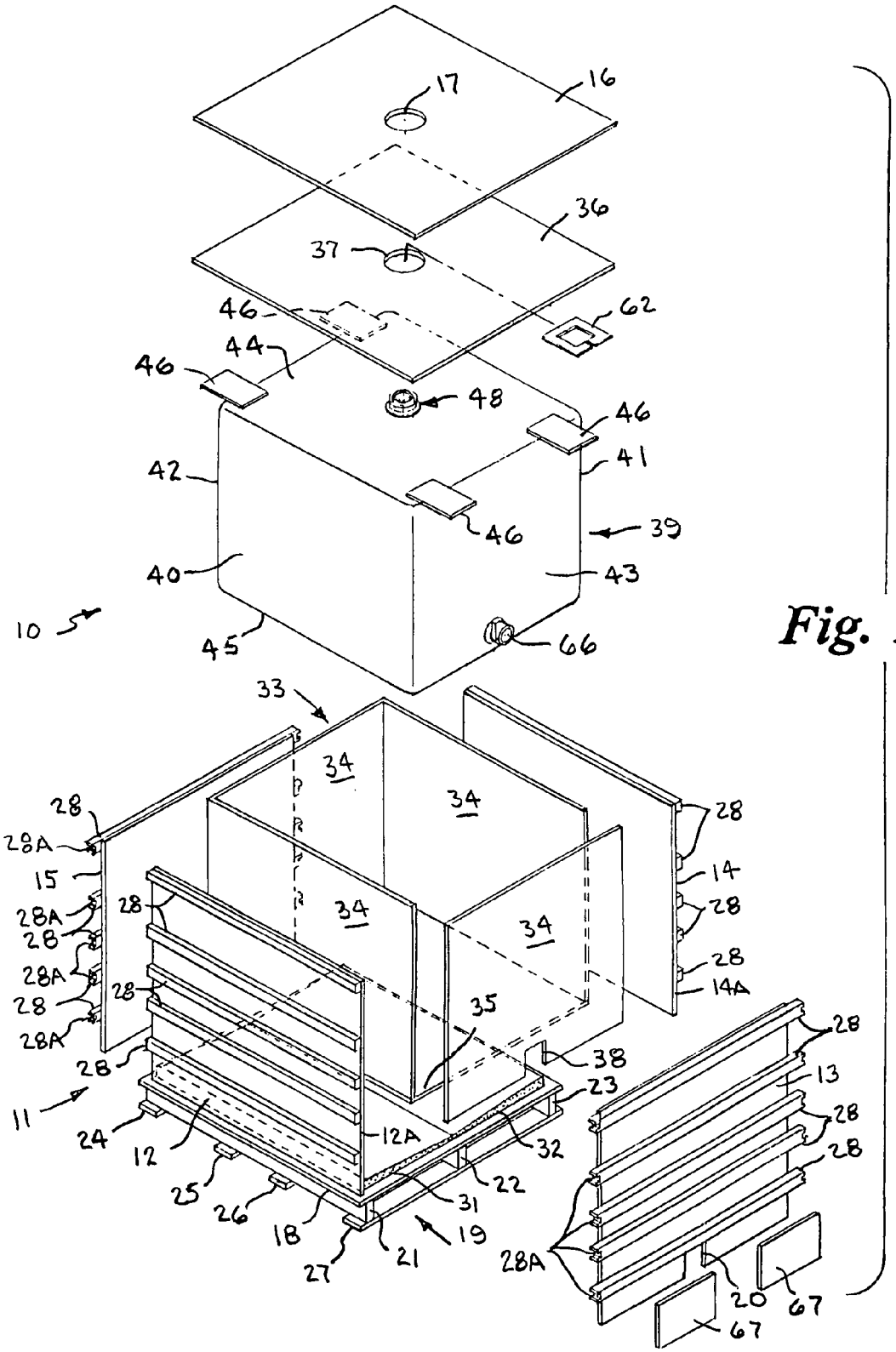
FIG. 2 is an exploded perspective view of the shipping container, showing the outer shell, inner collapsible bag, bottom support wedges, and intermediate liner members in an unassembled condition.

Referring to the drawings by numerals of reference, a preferred embodiment of a fully assembled shipping container 10 is shown in FIG. 1, and is shown exploded in FIG. 2 to reveal the principal elements, which include an outer rigid shell 11 with an integral pallet 19, a pair of support wedge members 31, 32 disposed inside the shell at the bottom thereof, an intermediate liner 33, and a flexible bag 39. The rigid outer shell 11 protects the inner bag 39 and its contents from blunt trauma and the integral pallet structure 19 permits individualized transportation and storage of the shell and its contents.

The outer shell 11 is constructed of four side walls 12, 13, 14 and 15, a top wall 16 with a circular hole 17 at the center thereof and a bottom wall 18 with an integral pallet 19. One of the side walls 13 is provided with a central generally rectangular opening 20 at its bottom end. The bottom wall 18 also serves as the pallet deck. The pallet 19 is formed by the deck (bottom wall 19), three wooden skids 21, 22 and 23 attached to the underside of the deck in parallel equally spaced relation, and four horizontally disposed wooden bottom boards 24, 25, 26 and 27 attached to the bottom of the wooden skids and extending transversely relative thereto. The integrated pallet configuration is capable of supporting not only the weight of one container and its contents, but also is capable of supporting the weight of several stacked containers and provides openings on all four sides capable of receiving the forks of a fork lift as described below. The deck, skids and bottom boards can be made of any nailable and stapleable material. The pallet 19 is permanently attached to the outer shell by joining the bottom wall 18, at its upper surface, to the bottom edges of the outer shell walls 12, 13, 14 and 15 by any convenient means such as nailing. The outer shell walls 12, 13, 14 and 15 are not attached to each other. The 4-way multi-directional fork lift access is advantageous in that it allows better access for lifting and handling of the container and significantly reduces the likelihood of damage, spillage or leakage due to accidentally dropping a filled container.

The outer shell 11 is rigid and strong and is preferably constructed of plywood or medium density fiberboard (MDF), however, other materials capable of being nailed or stapled can be used. For example, the material may be wood, particle board, flake board or oriented strand board. An outer shell constructed of medium density fiberboard (MDF) is advantageous in that it provides a smooth interior surface. Wooden reinforcing cleats 28 traverse the horizontal perimeter of the outer shell 11 and accommodate horizontal strapping bands 29 made of steel or the like, which, in final assembly, position and secure the side walls in the desired position. Longitudinal (vertical) strapping bands 30 secure the top wall 16 to the container shell 11.

As best seen in FIG. 2, the cleats 28 of opposing side walls 13, 15 extend beyond lateral sides of the walls, and the outer ends of these cleats are provided with a slot 28A. The cleats 28 of opposing side walls 12, 14 are about the same length as the width of the side walls and do not have a slot at their outer ends. When the container is assembled, the portions of the cleats 28 of side walls 13, 15 which extend beyond their lateral sides rest against and overlap the cleats 28 and edges 12A, 14A of side walls 12, 14, respectively. Thus, the side walls 12, 14 and their cleats 28 are located between the cleats 28 of the side walls 13, 15. As a result, the side walls 13, 15 are located between the sidewalls 12, 14. The slots 28A at the outer ends of the of the cleats 28 of side walls 13, 15 provide slotted corners to facilitate alignment of the horizontal straps 29, as described hereinafter. This positioning of the side walls and cleats is advantageous. Without this positioning, the force of the horizontal straps 29 would collapse the container side walls 12, 13, 14, 15. Constructing the container side walls of plywood or medium density fiberboard (MDF) is advantageous in that the rigidity and strength of the materials allows a minimal number of horizontal cleats and straps to be used and thereby reduces the cost of materials and assembly time.

Figure 3:
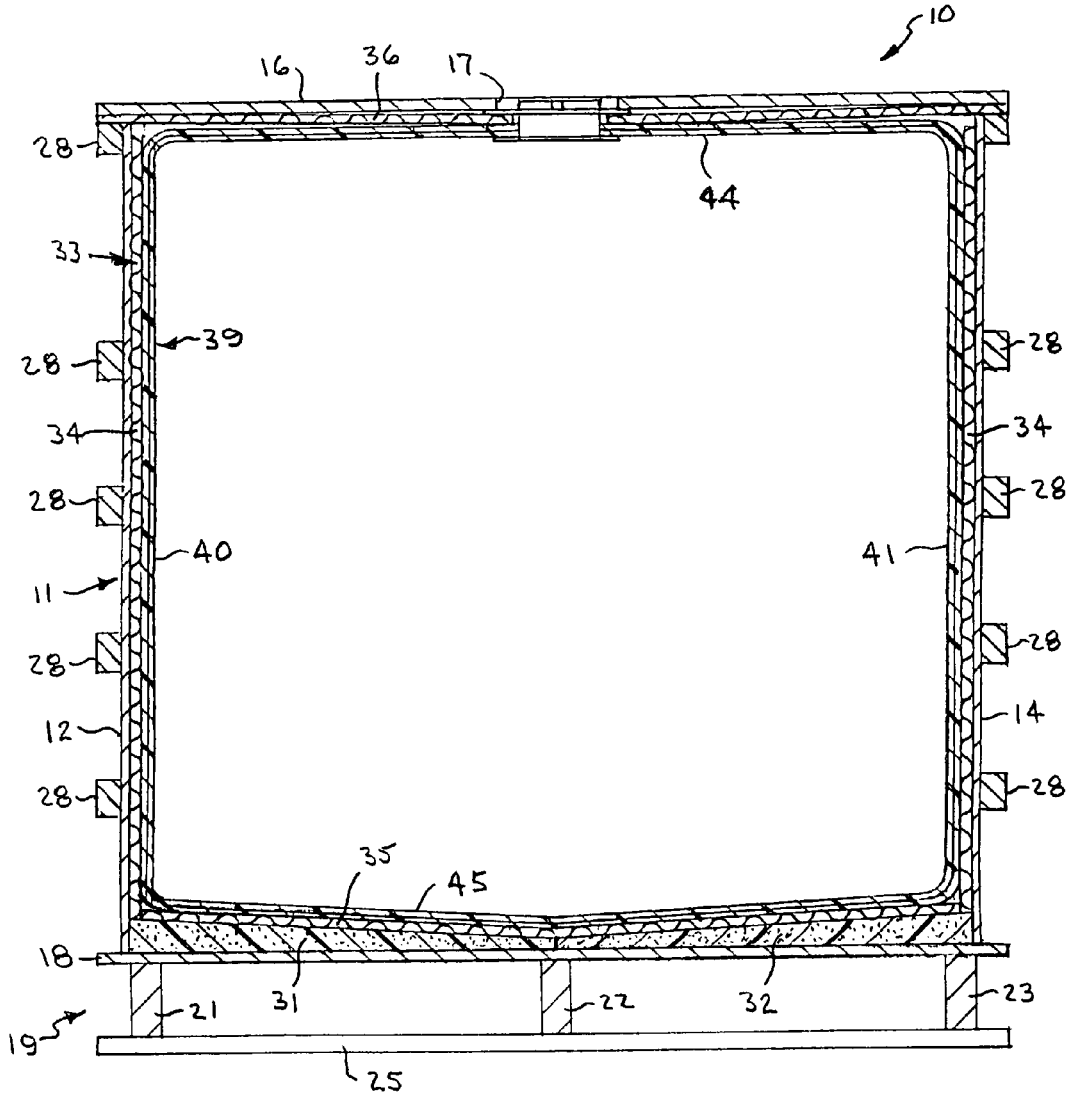
FIG. 3 is a vertical cross section of the assembled shipping container taken along line 3-3 of FIG. 1.

As seen in FIGS. 2 and 3, a pair of support wedge members 31 and 32 formed of EPS (expanded polystyrene) foam or other suitable cushioning material are supported in the interior of the outer shell 11 on the bottom wall 18 thereof. Each wedge member 31, 32 has a flat bottom surface, a short longitudinal side at one end, a taller longitudinal side at an opposed end and, and an angular top surface that extends between the shorter and taller sides. The wedge members 31, 32 are disposed on the on the bottom wall 18 in laterally opposed relation with their shorter longitudinal sides facing each other and their angular top surfaces extending downwardly from opposed side walls 12 and 14 of the shell to form a cushioning inwardly and downwardly angled drain surface or valley at the bottom of the container for supporting the bottom of the intermediate liner and the compressible bag. The valley of the drain surface extends in the same direction as the axis of a discharge valve 66 on the bag 39 (described below), to channel the contents to the center of the bag bottom in alignment with the discharge valve and thereby facilitate optimal emptying of the bag, significantly reduce the amount of residual material remaining in the bag, and provide an additional cushioning support surface for the fluid filled bag.

The intermediate liner 33 is formed of corrugated fiberboard, or other suitable cushioning material and is positioned between the interior of the outer shell 11 and the exterior of the bag 39 to serve as an abrasion dissipating means that absorbs relative movement between the collapsible bag and the shell so the bag is not subject to abrasive contact with the inner surfaces of the outer shell, and provides a protective cushioning surface for the heat sealed edges of the bag. The liner 33 has four side walls 34, a bottom wall 35 and a top wall 36 constructed to the dimensions of the inner cavity formed by the outer shell 11. The top wall 36 is provided with a circular hole 37 at the center thereof. The bottom wall 35 is supported on the support wedges 31, 32, and one of its side walls 34 is provided with a rectangular opening 38 at its bottom end in alignment with the opening 20 in the side wall 13 of the outer shell 11 to accommodate the discharge valve secured to the bag 1.

Figure 4:
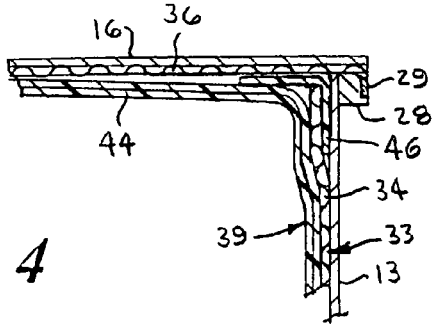
FIG. 4 is a cross sectional view of a side portion of the assembled shipping container, showing the flaps of the bag secured between the intermediate liner and the outer shell.

The reinforced multiple ply collapsible bag 39 is received in the intermediate liner 33 and is provided with means for attaching the bag 39 to the outer shell 11 as shown in FIGS. 1, 3 and 4. The bag 39 has four side walls 40, 42, 42 and 43, top wall 44 and a bottom wall 45 which meet at their respective corners as shown in FIG. 1 to form a cube-shaped bag which, when inflated, fits closely within the internal dimensions of the liner and outer rigid shell. The bag 39 is constructed such that the end walls are heat sealed at the appropriate corners to form a unitary, airtight collapsible bag. Cube-shaped bags are typically easier to fill, have fewer folds and retain less residual product after dispensing than pillow shaped bags, however, a pillow-shaped bag may be used in some applications. The bag 39 has four generally rectangular flaps 46, each having one end secured along the top wall 44 or the top portion of the side walls 42 and 43 in laterally spaced relation to form extensions of the bag material and an outer end extending outward from the bag. As shown in FIG. 4, the flaps 46 are of sufficient length to extend over the top of the liner side walls 34 and be sandwiched between the outer walls of the shell 11 and the intermediate liner 33, to maintain the bag in an erect, uncollapsed configuration. The outer ends of the flaps 46 may be secured to the side walls of the shell 11 by stapling, nailing, or other conventional means.

Figure 5:
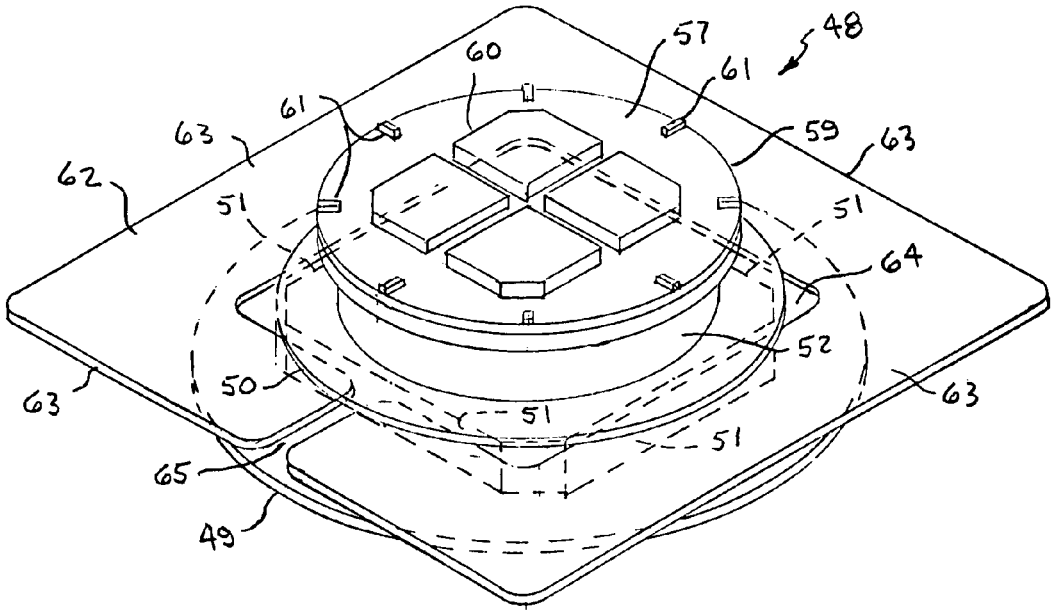
FIG. 5 is a perspective view a bung and retainer flange for supporting the top of the bag.
Figure 6:
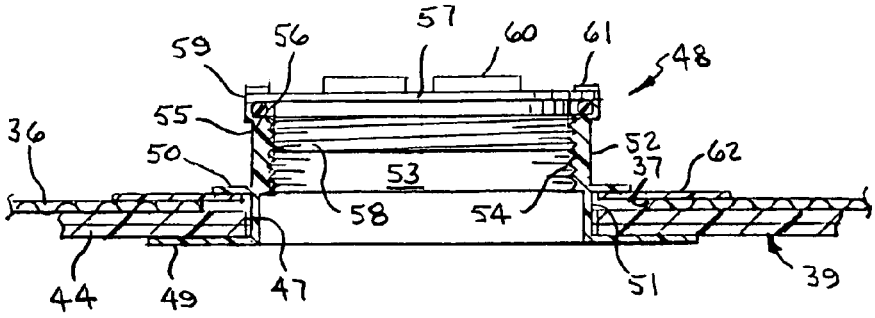
FIG. 6 is a cross sectional view of the bung and retainer flange mounted on the intermediate liner and supporting the top of the bag.

Referring additionally to FIGS. 5 and 6, the bag 39 is provided with an opening 47 in its top wall in which a bung 48 is mounted for permitting flow of liquid into and out of the bag. The bung 48 has a flat circular bottom flange 49 which is heat sealed around the opening 47 in the top wall 44 of the bag, a second circular flange 50 of smaller diameter spaced a short distance above the bottom flange, a polygonal portion extending between the two flanges with four opposed flat surfaces 51, and a cylindrical neck portion 52 extending upwardly from the flange 50. The interior of the bung 48 has a central bore 53 in fluid communication with the interior of the bag 39 and is provided with interior threads 54 and an annular O-ring shoulder 55 at its top end which receives an O-ring 56.

A plug 57 having external threads 58 and a circular flange 59 extending radially outward therefrom is threadedly engaged in the interior threads 54 of the bung 48 such that the flange 59 compresses the O-ring 56 and forms a fluid tight seal at the top end of the bag. The plug 57 is provided with a raised tool-receiving top surface 60 having flats, slots, and/or circumferentially spaced protrusions 61 for receiving a tool to install and remove the plug.

As described above, the top wall 36 of the intermediate liner 33 has a hole 37 at the center thereof which, when assembled, is aligned with the hole 17 in the top wall 16 of the shell 11. A retaining flange 62 is provided for releasably retaining the bung 48 on the top wall 36 of the liner to maintain the bung in a proper position and prevent the top of the bag 39 from sagging. The retaining flange 62 is a thin flat generally rectangular frame-like member formed of relatively stiff plastic material having four opposed sides 63 surrounding a central rectangular opening 64. One of the sides 63 has a narrow gap 65 extending from the opening 64 to the exterior of the retainer flange 62. The retainer flange 62 is installed on the bung 48 by spreading or twisting two opposed sides adjacent to the gap apart a sufficient distance to fit over the smaller second flange 50 of the bung 48 and then releasing them such that the sides 63 of the retainer flange are disposed closely adjacent to the flats 51 of the bung, and the outer periphery of the smaller second flange of the bung overlaps the four sides of the retainer flange.

When installed, the four sides 63 of the retainer flange 62 overlap the hole 37 in the top wall 36 of the intermediate liner 33 and the retainer flange is supported on the top wall of the liner, and the smaller diameter second flange 50 of the bung 48 is supported on the four sides of the retainer flange. Thus, the bung 48 is captured and supported on the top wall 36 of the liner 33 and maintained within the hole 17 of the top wall 16 of the outer shell 11 with the top of the bung plug 57 disposed approximately flush or slightly below the top surface of the outer shell top wall, and thus, the top of the bag 39 is prevented from sagging.

The bag 39 is provided with an opening in one side wall 43 near its bottom end in which the discharge valve 66 is mounted. The discharge valve 66 has a flat circular flange at its back end which is heat sealed around the opening in the side wall 43 of the bag 39 and has a fluid flow passageway in communication with the interior of the bag and a valve closure element in the passageway that is movable between a closed position shutting off fluid flow through the passageway, and an open position allowing fluid to flow through the passageway. As described above, the intermediate liner 33 has a rectangular opening 38 at the bottom of one of its side walls 34 at the center thereof in alignment with the opening 20 in the side wall 13 of the outer shell 11. The valve body extends through the opening 38 in the intermediate liner 33 and the opening 20 in the side wall 13 of the outer shell 11 and terminates approximately flush with, or a short distance inwardly from, the outer edges of the cleats 28. The valve body may be provided with laterally opposed flat surfaces to be engaged by the lateral sides of the opening 38 in the intermediate liner 33 or the opening 20 in the side wall 13 of the outer shell 11 to retain the valve in a proper position during transport and dispensing operations. The valve body may also be provided external threads at its outer end on which an end cap may be threadedly engaged to close the outer end of the valve during transport and storage.

In a preferred embodiment, the discharge valve 66 is a butterfly valve provided with a disc-type valve closure element having a peripheral O-ring, a rotatable valve shaft, and an operating lever removably mounted on the shaft, however, other types of valves for controlling the dispensing or discharge of materials could be likewise incorporated, including but not limited to ball valves, diaphragm valves, etc. The butterfly valve may also be provided with locking means to prevent accidental rotation of the valve shaft and opening of the valve closure element.

The container 10 is assembled by first constructing the pallet 19 and shell 11, and then installing the support wedges 31, 32, the liner 33, and the bag 39. The pallet skids 21, 22 and 23 are secured to the bottom wall 18 and the bottom boards 24, 25, 26 and 27 are secured to the stringers by nailing or other conventional means. The shell 11 is then constructed by nailing, or similarly affixing, the pallet 19 to the bottom edges of the outer shell sidewalls 12, 13, 14 and 15 to the pallet 19. The slots 28A at the outer ends of the of the cleats 28 of side walls 13, 15 provide slotted corners. The assembly of the side walls is secured by strapping horizontal steel bands 29 in the slotted corners 28A and around the cleats 28 to retain the side walls 12, 13, 14 and 15. Once the pallet and side walls are secured, an inner cavity is available for insertion of the wedges 31, 32 and intermediate liner 33.

The support wedge members 31 and 32 are placed on the bottom wall 18 of the outer shell 11 in laterally opposed relation with their shorter longitudinal sides facing each other. The bottom wall 35 and side walls 34 of the intermediate liner 33 are placed inside the cavity with the bottom wall 35 supported on the support wedges 31, 32. The bag 39 is then inserted inside the liner 33. The flaps 46 of the bag are stapled or otherwise secured to the top portion of the shell side walls 13 and 15 such that the flaps are sandwiched between the outer walls of the liner and the outer shell. The body of the valve 66 is fitted through the opening 38 in the side wall 34 of the liner 33 and the opening 20 in the side wall 13 of the outer shell 11. A pair of rectangular boards 67 are nailed or otherwise secured to the cleat 28 above the valve at each side of the valve and extend downwardly to the bottom wall 18 of the outer shell to further protect the valve. The top wall 36 of the intermediate liner 33 is placed atop the bag 39 and secured by the retainer flange 62, as described above, and the top wall 16 of the outer shell is secured to the top edges of the outer shell sidewalls 12, 13, 14 and 15 with the with the top of the bung plug 47 disposed approximately flush or slightly below the top surface of the outer shell top wall.

As seen in FIG. 1, a first pair of vertical straps 30 are wrapped about the top wall 16, cleats 28 and beneath the deck 18 of the pallet 19 between the pallet skids 21, 22 and 23 and then a second pair of vertical straps 30 are wrapped about the top wall 16, cleats 28 and beneath the pallet skids 21, 22 and 23 between the bottom boards 24, 25, 26 and 27 of the pallet 29 in transverse relation to the first pair of straps.

The cleats 28 prevent bowing of the sidewalls 12, 13, 14 and 15 due to the force of the horizontal straps 29. The cleats 28, horizontal straps 29 and vertical straps 30 provide structural strength to the container 10 to hold the weight of a full load of liquid, paste, slurry, etc. in the bag 39.

The amount of liquid load held by the present container is significant. In the case of a 330 gallon water load, the load weight is about 2,750 pounds. It is a significant achievement to be able to load 330 gallons (equal to six 55 gallon drums) into a container having a rectangular cubic shape. Such a container holds the volume of six drums in the space of four drums.

Furthermore, the present container has a significant advantage over other containers, such as those having a corrugated shell. The design of the outer shell of the present container provides structural strength to not only contain a full load of liquid, but also such that fully loaded, the container can be stacked three high for storage. Thus in the space of four drums stacked three high, for a total of twelve drums, the present container stacked three high, holds the volume of eighteen barrels or drums.

The above described shipping container may be used to ship bulk fluids under severe shipping conditions and then, after shipment the product may be dispensed from the top or bottom. The emptied container shell may be then be disassembled and discarded or may be reused by insertion of a new collapsible bag.

While this invention has been described fully and completely with special emphasis upon a preferred embodiment, it should be understood that within the scope of the appended claims the invention may be practiced otherwise than as specifically described herein.

The invention claimed is:

1. A container and supporting pallet-like structure for the container for bulk handling of fluid which minimizes shock and abrasion on a fluid transporting bag within the container wherein the container elements are shaped to maximize the quantity of fluid containable therein and the container elements are structured to withstand the pressure exerted by such fluid and permit easy ingress and egress of the fluid from the container, comprising:

a rigid outer shell adapted to withstand shock during transportation, comprising a rectangular top wall having a hole therethrough, and four rectangular side walls, one of said side walls having an opening at a bottom end thereof, the inside of said walls being flat, said shell top wall and shell side walls being made of a material capable of attachment by nails or staples, said shell side walls being in abutting contact but unattached to each other;

a pallet-like structure particularly adapted for permitting movement and storage of said shell without contact with said shell top wall, said pallet-like structure comprising a rectangular deck which is permanently attached to said shell side walls and serves as a bottom wall for said shell, said deck having a flat upper surface, said pallet-like structure being made of a material capable of attachment by nails or staples;

a flexible multiple ply bag disposed inside said shell, said bag having side walls, a bottom wall, and a top wall defining an interior with a capacity of from about 150 gallons to about 400 gallons, and integral outwardly extensible flaps adjacent an upper end thereof, each being attached to an inside top portion of at least two of said shell side walls for securing said bag in an erect uncollapsed configuration within said container;

a generally cylindrical bung having a flat circular bottom flange heat sealed around an opening in said bag top wall, a second circular flange of smaller diameter spaced a short distance above said bottom flange, at least two laterally opposed flat surfaces extending between said bottom flange and said second flange, a cylindrical neck portion extending upwardly from said second flange, a passageway in communication with said bag interior for permitting fluid passage into or out of said bag interior through said bag top wall, interior threads in said passageway and an annular O-ring shoulder at its top end in which an O-ring is installed, and a removable closure member threadedly engaged in said passageway;

a discharge valve heat sealed to said bag adjacent said bottom wall thereof having a passageway in communication with said bag interior and a valve closure element in said passageway movable between a closed position shutting off fluid flow through said passageway and an open position allowing fluid to flow through said passageway;

a corrugated liner disposed between said outer shell and said bag, for protecting said bag against abrasion during transportation of said container, said liner comprising a rectangular top wall having a hole therethrough in alignment with said hole in said shell top wall, and four rectangular side walls, one of said side walls having an opening at a bottom end thereof in alignment with said opening in said shell side wall;

reinforcing cleats attached to said shell side walls traversing the horizontal perimeter outer side of said shell;

horizontal straps adapted to be positioned about said cleats for holding said shell sidewalls in contact with each other, and vertical straps adapted to be positioned about the vertical perimeter outer side of said shell for holding said shell top wall in contact with said shell sidewalls;

said bung and its said closure member protruding through said hole in said corrugated liner top wall and into said hole in said shell top wall and being sufficiently flush with said shell top wall to enable stacking of another container upon said shell top wall, and said discharge valve body protruding through said corrugated liner opening and said shell side wall opening but not protruding further outside said shell side wall than does said cleats; and bung retainer means removably disposed between said corrugated liner top wall and said bung for releasably retaining said bung and its said closure member in said hole in said shell top wall and substantially reducing sagging of said bag top wall.

2. The container according to claim 1, wherein said bung retainer means comprises a thin flat retainer member removably positioned between said corrugated liner top wall and said bung second flange, said retainer member having at least two laterally opposed sides with inner facing flat surfaces extending over said hole in said corrugated liner top wall and disposed closely adjacent to said laterally opposed flat surfaces of said bung, and said bung second flange overlapping said retainer member laterally opposed sides such that bung is supported thereon.

3. The container according to claim 1, wherein said removable closure member at said bung outer end comprises a plug having external threads engageable with said bung interior threads and a circular flange extending radially outward therefrom to compress said O-ring and form a fluid tight seal in said bung passageway to prevent communication with said bag interior when engaged with said bung.

4. The container according to claim 1, wherein said multiple ply bag outwardly extensible flaps comprise a first pair of outwardly extensible flaps disposed in laterally spaced relation and extending outwardly relative to a first side wall of said bag, and a second pair of outwardly extensible flaps disposed in laterally spaced relation and extending outwardly relative to an opposed side wall of said bag, each of said pair of flaps extending over a top edge of opposed liner side walls and sandwiched between said opposed liner side walls and opposed side walls of said shell.

5. The container according to claim 1, wherein each cleat on a first opposing pair of said shell side walls has about the same length as each side wall of said first opposing pair and each cleat of a remaining opposing pair of said shell side walls have a greater length than each side wall of said remaining opposing pair and having a slot formed in opposed outer ends;

said first opposing pair of side walls and its cleats being between said cleats of said remaining opposing pair of side walls;

said remaining opposing pair of side walls being between said first opposing pair of side walls, thereby preventing collapse of said shell sidewalls due to the force of said horizontal straps; and said slots of said cleats of said remaining pair of opposing side walls providing slotted corners for aligning said horizontal straps.

6. The container according to claim 1, wherein said pallet-like structure is configured to provide openings on four sides capable of receiving the forks of a fork lift.

7. The container according to claim 6, wherein said pallet-like structure comprises a plurality of elongate rectangular wooden skids having a top edge secured to the underside of said deck in parallel equally spaced relation, and a plurality of horizontally disposed wooden bottom boards secured to a bottom edge of said skids and extending transversely relative thereto.

8. The container according to claim 1, wherein said shell top wall and shell side walls are made of a material selected from the group consisting of plywood, medium density fiberboard, wood, particle board, flake board and oriented strand board.

9. The container according to claim 1, wherein said corrugated liner is made of corrugated fiberboard.

10. The container according to claim 1, wherein said bag is heat sealed to have a generally rectangular cube shape.

11. The container according to claim 1, wherein said bag has a volume from about 250 gallons to about 350 gallons.

12. A container and supporting pallet-like structure for the container for bulk handling of fluid which minimizes shock and abrasion on a fluid transporting bag within the container wherein the container elements are shaped to maximize the quantity of fluid containable therein and the container elements are structured to withstand the pressure exerted by such fluid and permit easy ingress and egress of the fluid from the container, comprising:

a rigid outer shell adapted to withstand shock during transportation, comprising a rectangular top wall having a hole therethrough, and four rectangular side walls, one of said side walls having an opening at a bottom end thereof, the inside of said walls being flat, said shell top wall and shell side walls being made of a material capable of attachment by nails or staples, said shell side walls being in abutting contact but unattached to each other;

a pallet-like structure particularly adapted for permitting movement and storage of said shell without contact with said shell top wall, said pallet-like structure comprising a rectangular deck which is permanently attached to said shell side walls and serves as a bottom wall for said shell, said deck having a flat upper surface, said pallet-like structure being made of a material capable of attachment by nails or staples;

a flexible multiple ply bag disposed inside said shell, said bag having side walls, a bottom wall, and a top wall defining an interior with a capacity of from about 150 gallons to about 400 gallons, and integral outwardly extensible flaps adjacent an upper end thereof, each being attached to an inside top portion of at least two of said shell side walls for securing said bag in an erect uncollapsed configuration within said container;

a generally cylindrical bung heat sealed to said bag top wall having a passageway in communication with said bag interior for permitting fluid passage into or out of said bag interior through said bag top wall, and a removable closure member at an outer end of said bung;

a discharge valve heat sealed to said bag adjacent said bottom wall thereof having a passageway in communication with said bag interior and a valve closure element in said passageway movable between a closed position shutting off fluid flow through said passageway and an open position allowing fluid to flow through said passageway;

a corrugated liner disposed between said outer shell and said bag, for protecting said bag against abrasion during transportation of said container, said liner comprising a bottom wall, a rectangular top wall having a hole therethrough in alignment with said hole in said shell top wall, and four rectangular side walls, one of said side walls having an opening at a bottom end thereof in alignment with said opening in said shell side wall;

a cushioning drain surface disposed in said outer shell between said corrugated liner bottom wall and said rectangular deck that serves as said bottom wall for said shell, said drain surface formed of cushioning material having a top surface extending angularly inward and downward from laterally opposed side walls of said shell to form a valley extending in the same direction as an axis through said discharge valve to channel contents of said bag to the center of said bag bottom wall and thereby facilitate optimal emptying of the bag, significantly reduce the amount of residual material remaining in said bag, and provide an additional cushioning support surface for said bag;

reinforcing cleats attached to said shell side walls traversing the horizontal perimeter outer side of said shell;

horizontal straps adapted to be positioned about said cleats for holding said shell sidewalls in contact with each other, and vertical straps adapted to be positioned about the vertical perimeter outer side of said shell for holding said shell top wall in contact with said shell sidewalls;

said bung and its said closure member protruding through said hole in said corrugated liner top wall and into said hole in said shell top wall and being sufficiently flush with said shell top wall to enable stacking of another container upon said shell top wall, and said discharge valve body protruding through said corrugated liner opening and said shell side wall opening but not protruding further outside said shell side wall than does said cleats.

13. The container according to claim 12, wherein said cushioning drain surface is made of expanded polystyrene foam material.

14. The container according to claim 12, wherein said cushioning drain surface comprises a pair of wedge members, each having a flat bottom surface, a short longitudinal side at one end, a taller longitudinal side at an opposed end and, and an angular top surface that extends between the shorter and taller sides, said wedge members disposed in laterally opposed relation with their said shorter longitudinal sides facing each other and their said angular top surfaces extending downwardly from opposed side walls of said outer shell.

* * * * *